US005170906A

United States Patent [19]

Kochelek

[11] Patent Number: 5,170,906

[45] Date of Patent: Dec. 15, 1992

[54] AIR CHANNEL SYSTEM FOR TRASH CONTAINERS

[76] Inventor: Matthew Kochelek, 11817 Talisman Ct., St. Louis, Mo. 63138

[21] Appl. No.: 889,162

[22] Filed: May 27, 1992

[51] Int. Cl.[5] ..... B65D 90/04

[52] U.S. Cl. ..... 220/402; 220/404; 220/908; 220/671

[58] Field of Search ..... 229/120, DIG. 2, DIG. 14; 383/101; 220/404, 403, 462, 908, 909, 461, 671, 670, 402

[56] References Cited

U.S. PATENT DOCUMENTS

| | | | |
|---|---|---|---|
| 1,736,192 | 11/1929 | Easton | 220/404 |
| 2,006,705 | 7/1935 | Bangs | 220/402 |
| 2,444,861 | 7/1948 | Symmes | 220/403 |
| 2,585,289 | 2/1952 | Wallace | 229/120 |
| 2,633,006 | 3/1953 | Taylor | 220/403 |
| 2,678,764 | 5/1954 | Carlson . | |
| 3,484,011 | 12/1969 | Greenhalgh et al. . | |
| 3,779,156 | 12/1973 | Race | 220/402 |
| 3,937,355 | 2/1976 | Engebretsen | 220/404 |
| 4,122,973 | 10/1978 | Ahern | 220/404 |
| 4,140,257 | 2/1979 | Peterson | 220/404 |
| 4,294,379 | 10/1981 | Bard | 220/404 |
| 4,715,572 | 12/1987 | Robbins, III et al. . | |
| 4,867,328 | 9/1989 | McCarthy | 220/404 |
| 4,941,653 | 7/1990 | Sterner, Jr. . | |
| 4,974,746 | 12/1990 | Dickinson | 220/404 |
| 5,031,796 | 7/1991 | Schafer et al. | 220/908 |

FOREIGN PATENT DOCUMENTS

| | | | |
|---|---|---|---|
| 197901 | 1/1979 | United Kingdom | 220/402 |

*Primary Examiner*—Allan N. Shoap
*Assistant Examiner*—S. Castellano
*Attorney, Agent, or Firm*—Rogers, Howell & Haferkamp

[57] ABSTRACT

A ribbed trash container suitable for supporting a collapsible trash liner comprising a hollow body having an open top, a closed bottom, and an interior surface portion provided with a plurality of laterally spaced apart, generally vertical ribs. The ribs define between themselves a plurality of narrow channels that extend longitudinally between the open top and closed bottom. In another embodiment, the ribs and channels are formed in an adaptor piece for assembling with and upgrading a standard trash container. The channels of either embodiment have such narrow laterally dimensioned openings that projections of the liner are generally unable to enter the channels to a degree which would significantly obstruct the passage of air therethrough. The channels provide a passage for the escape of air trapped between the container and liner during filling of the liner; and the channels also provide for the passage of air during the removal of the liner from the container, thereby preventing the formation of a vacuum that would tend to cause the retention of the liner inside the container.

6 Claims, 1 Drawing Sheet

AIR CHANNEL SYSTEM FOR TRASH CONTAINERS

BACKGROUND OF THE INVENTION (1) Field of the Invention

The present invention generally relates to trash containers and flexible, collapsible container liners of the type often employed in collecting yard, house and workplace refuse and other similar types of refuse. More particularly, the present invention relates to an air channel system for eliminating a vacuum in a trash container that is commonly experienced during removal of a trash-filled liner from the container, which if not eliminated undesirably tends to cause the retention of the liner inside the container. One embodiment of the present invention involves a unitary trash container having an air channel system integrally formed with the trash container sidewall. Another embodiment of the present invention involves an adaptor piece attaching to the sidewall of most any standard, commercially available trash container.

(2) Description of the Related Art

Air ventilation systems for trash containers are known in the art. Some air ventilation systems are integrally formed in a trash container sidewall. Containers employing these types of prior art systems typically have pleated sidewalls. The pleats give the sidewalls a "wavy" or corrugated configuration, both inside and out. Generally, the pleats define between themselves a plurality of circumferentially spaced apart, generally vertical conduits. The conduits generally extend vertically from the closed bottom to the open top of the trash container and, in consequence, permit the conduction of air between the container sidewall and a liner inserted into the container, back and forth between the open top and areas within the container cavity near the closed bottom. A prior art system of the type described above is shown by U.S. Pat. No. 4,715,572.

Other prior art air ventilation systems generally comprise hollow tubes (though not necessarily cylindrical tubes) for attaching to a trash container sidewall. These types of prior art air ventilation systems essentially consist of a customized component for a limited range of trash container configurations having at least one substantially flat area of interior sidewall extending between the top and bottom of the container. When attached to a container sidewall, these hollow tubes have lower open ends positioned near the container bottom and upper open ends correspondingly positioned near the container top, and so provide the conduction of air back and forth between areas near the closed bottom and open top of the trash container. Prior art systems of this type are shown by U.S. Pat. Nos. 4,294,379 and No. 4,941,653.

There are several disadvantages associated with the prior art systems. The deficiencies of the integrated sidewall/air ventilation systems include the fact that the sidewall is often required to be formed in a "wavy" or corrugated configuration. As previously indicated, these types of systems achieve ventilation by virtue of the corrugated sidewall. These corrugated sidewalls are chiefly deficient in that they complicate the molding of the container and thereby increase the costs involved in the fabrication of the trash container. Providing corrugated sidewall in containers also often prevents their being stacked or nested one inside another.

As for the hollow tube systems, the fact that they generally consist of straight and rigid tube members requires that they be assembled to a container having generally planar surface portions. Few standard, commercially available trash containers have sidewalls that have the required planar surface. In addition, many hollow tube systems have significant cross-section dimensions in relation to the horizontal cross-section of the standard trash container. The hollow tube systems often project inwardly from the sidewalls into the container cavity to a significant extent, thereby occupying a noticeable percentage of the volume of the container cavity. One undesirable consequence of these substantially sized hollow tubes is that their lower ends project as small overhangs that are nevertheless large enough to catch or snag the trash liner often causing the liner to rip or tear as it is removed from the container. Another undesirable aspect involves the attachment of the hollow tube to the sidewall. Namely, the attached hollow tube presents a laterally narrow surface area for attachment to the container interior. Over a period of time, repeatedly removing filled trash liners from the container exerts forces on the sides of the tube that often tend to work the tube loose from its attachment to the container. Containers having tubes formed in their interiors are also often disadvantaged in that the tubes are expensive to fabricate in the containers, they often interfere with the containers being stacked or nested one inside another, and the interior of the tubes are difficult to clean.

What is needed to overcome the disadvantages of the integrated sidewall/air ventilation systems of the prior art is an improved air channel system in which the integrated configuration is not unduly complicated and expensive to fabricate and does not prevent stacking or nesting containers one inside another. What is needed to overcome the disadvantages of the tube type ventilation systems of the prior art is an improved air channel system that attaches easily to the trash container sidewall, does not project too far inwardly into the trash container cavity, nor present liner-tearing projections, all while providing ease of use with almost any standard, commercially available trash container, even those having sidewalls with surface contours that are other than planar.

SUMMARY OF THE INVENTION

In accordance with one embodiment of the present invention, a trash container is provided with at least one sidewall having an interior surface with a plurality of laterally spaced vertical ribs formed thereon. Each of the ribs of the plurality extend substantially parallel to each other between the margins of both the open top and closed bottom of the container. The ribs define between themselves narrow channels that communicate air between the closed bottom and open top. Consequently, these narrow channels provide a passage for the flow of air trapped between the container and trash liner during filling of the trash liner, and also prevent the creation of a vacuum pressure inside the container during removal of the trash liner from the container that otherwise would tend to cause the retention of the trash liner inside the container.

In another embodiment of the present invention, a substantially planar, flexible member having opposite first and second surfaces is provided for adhering to the interior surface of a sidewall of a standard trash container. The flexibility of the member permits it to conform to the contours of the interior surface of the sidewall. Accordingly, the member can be adhered to the sidewall of a container having a curvilinear or angular cross-section configuration. In addition, the sidewall can have a tapering vertical contour or curves or angles formed in the sidewall as it extends vertically. The flexible member can be cut to size so that it extends vertically between the closed bottom and open top of trash containers of varying height.

Air ventilation is achieved with the member by providing one of its surfaces with a plurality of laterally spaced, generally vertical ribs that define air channels between each other. The air channels are generally parallel to one another as they extend across the surface of the sheet between its opposite lateral edges. The opposite surface of the member is provided with some form of adhesive for adhering the member to the container interior sidewall. When the sheet is adhered to the container wall, the air channels formed by the ribs perform substantially the same functions and provide substantially the same advantages as the air channels of the first embodiment described above.

BRIEF DESCRIPTION OF THE DRAWINGS

Further objects and features of the present invention are revealed in the following detailed description of the preferred embodiments of the invention and in the drawing figures wherein.

DESCRIPTION OF THE PREFERRED EMBODIMENTS

Figure 1:
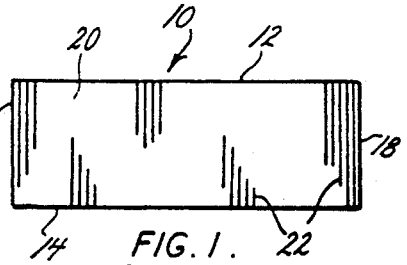
FIG. 1 is a front elevation view of a first embodiment of the air channel system for trash containers of the present invention.

With reference to FIG. 1, the first embodiment of the air channel system for trash containers of the present invention is shown apart from the container with which it is employed. As seen in FIG. 1, the first embodiment of the invention is generally comprised of a substantially planar, flexible member 10 having longitudinally spaced upper and lower edges 12, 14 and laterally spaced left and right side edges 16, 18. Although the first embodiment of the invention is shown in FIG. 1 as having a rectangular configuration with a larger lateral dimension than the longitudinal dimension, this configuration is illustrative only and should not be interpreted as limiting. The member 10 of the invention can have a variety of configurations other than that shown. The member 10 has a front surface 20, as viewed in FIG. 1, that is formed with a plurality of laterally spaced, generally vertical ribs 22 which extend longitudinally between the upper and lower edges 12, 14. The ribs 22 are closely spaced in a laterally parallel relationship to one another across the front surface 20 between the left and right side edges 16, 18. The member 10 is preferably formed of a flexible, plastic material that enables the member 10 to be easily extruded and/or cut to a desired shape and easily bent both parallel and transverse to the ribs 22.

Figure 2:
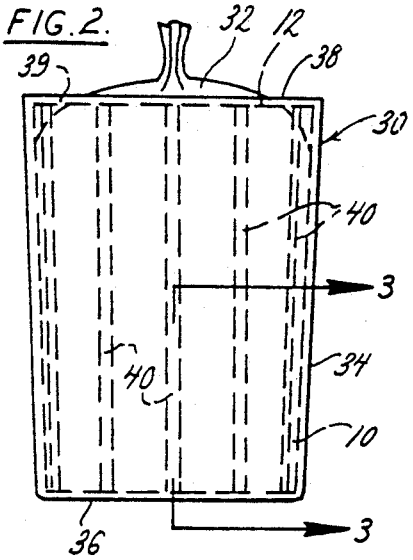
FIG. 2 is a front elevation view of one operative environment of the first embodiment, shown in broken lines together with a trash container and collapsible trash liner illustrating the use of the invention embodiment therewith.

Referring now to FIG. 2, a plurality of flexible members 10 are shown assembled with a conventional trash container 30 and collapsible trash liner 32. The trash container 30 is standard and comprises a generally vertically upstanding sidewall 34 joined to a closed bottom 36 which is opposite to an open top 38. The container may have a curvilinear, angular, or any other variety of cross-sectional configurations. The sidewall 34 and closed bottom 36 generally define a container cavity 39 which allows the plurality of flexible members 10 to be inserted thereinto and positioned against the interior surface of the sidewall with their front surfaces 20 facing radially inward.

Each of the plurality of flexible members 10 is secured to the interior surface of the trash container 30 by a plurality of adhesive strips 40 applied to the rear surface 50 of each member and extending between the upper and lower edges 12, 14. The strips 40 have adhesive on opposite sides, such as two-sided tape, and generally bond the interior surface 52 of the trash container 30 with the rear surfaces 50 of the flexible members 10, as generally illustrated.

Figure 4:
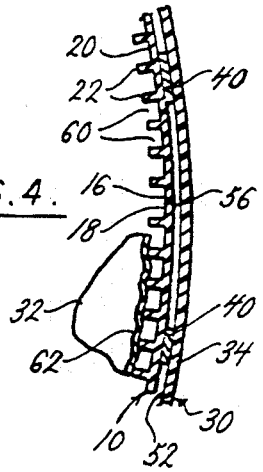
FIG. 4 is a partial elevation view, in section, taken generally along the line 4—4 of FIG. 3.

In assembling the plurality of flexible members 10 to the interior wall surface 52 of the container, each individual flexible member 10 is cut from a larger sheet with a sufficient longitudinal dimension to extend vertically between the closed bottom 36 and open top 38 of the container. The initial flexible member sheet may be provided in a sufficiently large size to enable several flexible member 10 of different configurations to be cut from the sheet, thus facilitating its use with a variety of differently sized trash containers. The user need only trim the upper and lower edges 12, 14, and the left and right side edges 16, 18 to the size needed. For the particular trash container 30 shown by FIG. 2, the left and right side edges 16 and 18 of the individual flexible members 10 may be trimmed to such a size that when the plurality of flexible members 10 are assembled inside the container 30, the left and right side edges 16, 18 mate close together to form a seam 56, as illustrated in FIG. 4. Alternatively, the plurality of flexible members may be adhered to the interior wall of the container in a spaced, side-by-side arrangement. It is not necessary that the entire interior surface 50 of the container sidewall be covered by the flexible members in order for the members 10 to function in the manner intended.

The particular trash container 30 shown has a sidewall 34 that has a circumferential contour generally defining a circle and a vertical contour that tapers inwardly in the downward direction (see FIG. 2). The flexible member 10 is suitably adapted for this and other sidewall configurations enabling it to be used with virtually any standard, commercially available trash container. For instance, standard trash containers standardly have sidewalls that have vertical contours that taper arcuately rather than linearly. In addition, polygonal rather than circular circumferential contours are also common. To meet these commonly encountered varieties, the flexible members 10 may be cut and applied in one or more bands of selected width (not illustrated) to the interior of most any container.

Figure 3:
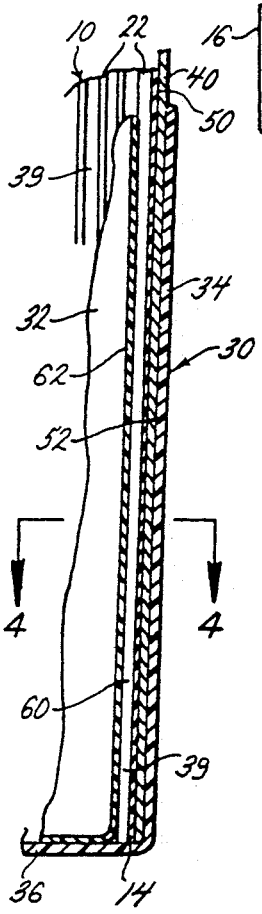
FIG. 3 is a partial elevation view, in section, of the first embodiment of the invention taken generally along the line 3—3 of FIG. 2.

In use (as illustrated in FIGS. 2, 3 and 4), the plurality of the narrowly spaced ribs 22 of each flexible member 10 face radially inward. These ribs 22 define between themselves a plurality of narrow air channels 60 which, like the ribs 22, extend longitudinally between the upper and lower edges 12 and 14 of the members 10. The rear surfaces 50 of each of the flexible members 10 are adhered to the interior wall surface 52 of the container by the adhesive strips 40. Glue and other methods of adhering the members to the container wall may also be used. As illustrated in FIG. 4, the collapsible trash liner 32 is inserted into the container with a flexible wall 62 of the liner positioned adjacent the flexible members 10. During filling of the trash liner 32, the flexible liner wall 62 bears against the ribs 22 of the members 10 but is generally unable to protrude into the channels 60 because of the selected narrowness of the lateral width of the channels. Otherwise, if the liner wall 62 could project into the channels to a significant degree it could undesirably obstruct the passage of air through the channels.

The upper and lower ends of the air channels 60 are positioned in areas near the open top 38 and closed bottom 36 of the container, respectively. As a consequence, the plural channels 60 enable air trapped between the trash container 30 and trash liner 32 to pass through the channels and exit the container as trash is deposited into the liner. The channels 60 also enable air to be drawn from outside of the container through the open top 38 and through the channels into the container interior beneath the liner as the filled liner is removed from the container interior. Suction typically caused by the removal of the trash liner 32 from the trash container 30 is prevented in this manner. The passage of air through the plural channels 60 prevents the creation of a vacuum pressure in the container interior beneath the liner that would otherwise occur and cause the retention of the trash liner 32 in the container cavity.

Figure 5:
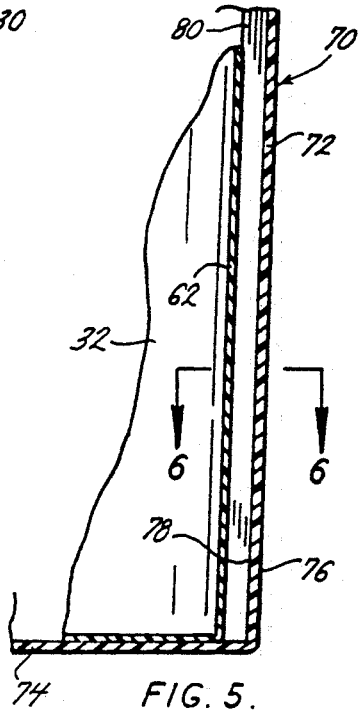
FIG. 5 is a partial elevation view, in section, of the second embodiment of the present invention together with a collapsible trash liner shown to illustrate the use of the invention therewith.
Figure 6:
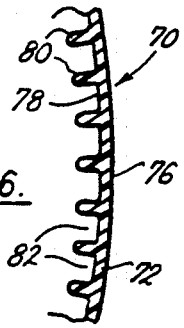
FIG. 6 is a partial plan view, in section, taken generally along the line 6—6 of FIG. 5.

A second embodiment 70 of an air channel system for trash containers is shown by FIGS. 5 and 6. Generally speaking, this embodiment 70 unifies the ribs 22 of the first embodiment 10 with a trash container sidewall. More specifically, the second embodiment 70 comprises an upstanding sidewall 72 of a container joined to a closed bottom 74, which is opposite to an open top (not illustrated) as is conventional. This embodiment of the invention can be formed in containers having a variety of different configurations. The upstanding sidewall 72 generally has a sheet-like thickness between an exterior surface 76 and an interior surface 78 of the sidewall. The interior surface 78 has a plurality of inwardly extending, circumferentially spaced vertical ribs 80, which generally extend longitudinally between the closed bottom 74 and open top (not illustrated). These plural ribs 80 define between themselves a plurality of narrow air channels 82, which, like the ribs 80, generally extend longitudinally between the closed bottom 74 and open top (not illustrated) of the container. The ribs 80, and likewise the air channels 82, are circumferentially spaced parallel to one another and can be formed unitarily with the container sidewall across the whole circumferential extent of the interior surface 78, or can be formed across definite arcs or segments thereof.

Figure 7:
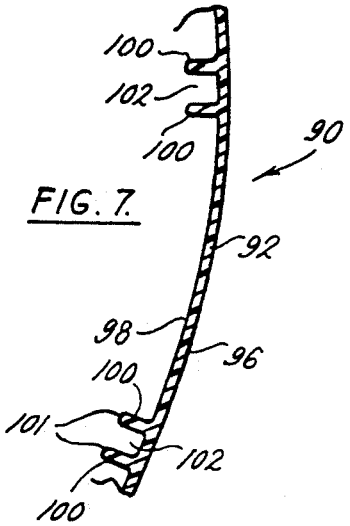
FIG. 7 is a partial plan view similar to FIG. 6 showing a third embodiment of the present invention.

A third embodiment 90 of an air channel system for trash containers is shown by FIG. 7. The third embodiment 90 is substantially similar to the second embodiment. It too is formed unitarily with a container having an upstanding sidewall 92 extending between a closed bottom and open top (neither illustrated) as is conventional. This embodiment of the invention may also be formed in a variety of containers having different configurations. The sidewall 92 of the container has opposite surfaces, an exterior surface 96 and an interior surface 98. The interior surface 98 has a plurality of inwardly extending, circumferentially spaced vertical ribs 100 formed unitarily therein, which generally extend longitudinally between the closed bottom and open top (not illustrated). The circumferential spacing of these vertical ribs 100, however, is rather different from that disclosed for the second embodiment. In this third embodiment 90, there are narrowly spaced pairs 101 of the vertical ribs 100 that are, as pairs, widely spaced apart around the circumference of the interior surface 98, as generally illustrated. While the third embodiment 90 also has narrow vertical air channels 102 formed between the ribs, the air channels 102 are defined only between the ribs 100 that are associated as pairs 101. The wide circumferential spaces between adjacent pairs 101 generally do not, on the other hand, define passages for air flow.

Both the air channels 82 of the second embodiment 70 and the air channels 102 of the third embodiment 90 are alike in that they present openings having narrow lateral widths into which projections of the flexible wall 62 of a trash liner 32 are generally unable to project and obstruct air flow therethrough. These air channels 82, 102 function in substantially the same manner and provide substantially the same advantages as the air channels 62 of the first embodiment 10.

While the present invention has been described by reference to specific embodiments, it should be understood that modifications and variations of the invention may be constructed without departing from the scope of the invention defined in the following claims.

What is claimed is:

1. In combination with a trash container of the type wherein a hollow container body has a closed bottom and an open top suitable for supporting a collapsible trash liner while trash is deposited thereinto, said follow body having at least one sidewall including a mounting surface generally extending between said closed bottom and open top;

an improvement comprising:

a generally planar, flexible member capable of flexing and conforming to contours of the mounting surface; the member having laterally spaced left and right edges extending between longitudinally spaced upper and lower edges, the member also having opposite first and second surfaces, the first surface being provided with a plurality of laterally spaced ribs that define between themselves a plurality of narrow channels that extend longitudinally between the upper and lower edges of the member, the channels having a predetermined lateral width that restricts the entry of portions of the liner into the channels to a degree that would thereby significantly obstruct the passage of air through the channels; and means for adjoining the second surface of the member to the mounting surface; wherein the channels provide a passage for air trapped between the container and liner during filling of the liner, the channels also provide for the passage of air there-through during the removal of the liner from the container, thereby preventing the creation of a vacuum pressure inside the container that would tend to cause the retention of the liner inside the container.

2. The improvement of claim 1 wherein:

the adjoining means comprises strips with adhesive on opposite sides.

3. The improvement of claim 1 wherein the channels are entirely exposed to an interior volume of the container.

4. The improvement of claim 1, wherein the flexible member is constructed of a material there is capable of being cut to form the flexible member in a variety of different configurations.

5. The improvement of claim 1, wherein the flexible member is constructed of a material that is capable of being cut to reduce the lateral spacing between the left and right edges of the member and thereby reduce a number of ribs in the plurality of ribs and reduce a number of channels in the plurality of channels.

6. The improvement of claim 1 wherein the flexible member is constructed of a material that is capable of being cut to reduce the longitudinal spacing between the upper and lower edges of the member.

* * * * *